US007448485B1

(12) United States Patent
Rutler

(10) Patent No.: US 7,448,485 B1
(45) Date of Patent: Nov. 11, 2008

(54) DIMENSIONALLY STABILIZED MOLDED TOKEN

(75) Inventor: Jay B. Rutler, Overland Park, KS (US)

(73) Assignee: Rutland, Inc, Olathe, KS (US)

( * ) Notice: Subject to any disclaimer, the term of this patent is extended or adjusted under 35 U.S.C. 154(b) by 0 days.

(21) Appl. No.: 11/444,923

(22) Filed: Jun. 1, 2006

(51) Int. Cl.
*G07F 1/06* (2006.01)
*G09F 3/02* (2006.01)

(52) U.S. Cl. ..... 194/214; 264/478; 40/27.5

(58) Field of Classification Search ..... 194/214; 273/288; 40/27.5; 428/66.5, 70
See application file for complete search history.

(56) References Cited

U.S. PATENT DOCUMENTS 3,597,383 A * 8/1971 Shrontz ..... 523/527
3,953,932 A 5/1976 Graves
3,968,582 A 7/1976 Jones
3,983,646 A 10/1976 Howard
4,435,911 A * 3/1984 Jones ..... 40/27.5
4,827,640 A 5/1989 Jones
5,166,502 A 11/1992 Rendleman et al.
5,361,885 A * 11/1994 Modler ..... 194/214
5,673,503 A 10/1997 Rendleman
5,676,376 A * 10/1997 Valley ..... 273/288
5,895,321 A * 4/1999 Gassies et al. ..... 463/29
6,036,099 A * 3/2000 Leighton ..... 235/488
6,372,320 B1 * 4/2002 Schumi et al. ..... 428/67
6,508,466 B1 1/2003 Rendleman
2006/0071425 A1 * 4/2006 Finch et al. ..... 273/288

* cited by examiner

*Primary Examiner*—Patrick Mackey
*Assistant Examiner*—Mark Beauchaine
(74) *Attorney, Agent, or Firm*—Erickson, Kernell, Derusseau & Kleypas, LLC

(57) ABSTRACT

A dimensionally stabilized token includes a rigid internal web structure for supporting molded external structures. The web may comprise material, such as metallic substances, selected to augment the overall weight of the token. The token further includes interlocking means, such as projections from a first molded portion, to dimensionally stabilize a second molded portion.

10 Claims, 4 Drawing Sheets

DIMENSIONALLY STABILIZED MOLDED TOKEN

BACKGROUND OF THE INVENTION

This invention relates generally to gaming chips or tokens, and more particularly to a novel token which is structurally reinforced by an internal web.

It is known in the field of gaming chips to produce a chip from molded plastic, and to mold portions of the chip sequentially and of contrasting colors to enhance aesthetics and interest by players. Gaming chips may also comprise molded indicia or areas of contrasting colored plastic that serve as decoration, to distinguish chip denomination and/or to identify a particular gaming establishment. Ideally, adjoining areas of contrasting colored plastic should present sharp, well-defined borders that do not slip or gap relative to one another during the life of the chip. Typically, plastic chips are formed from ABS plastic (acrylonitrile butadiene styrene), which is relatively inexpensive and yields a hard, shiny structure. Chips made from ABS will produce a rattling or clinking noise when dropped upon a hard surface or among other chips.

Plastic gaming chips may be constructed to include one or more metallic coins, or coin-shaped metallic disks, surrounded by one or more annular plastic rings. Typically, the metallic disks are provided for decoration and to increase chip weight or heft. Plastic chips having augmented weight are often preferred by players and gaming establishments since they can replicate the heft of clay or clay filled composite chips which were originally in common use in casinos. Augmented weight has become even more important in recent years as the industry standard has increased from 8-10 grams to 11.5 grams, with chips having weights as high as 13.5 grams now entering the market. In general, greater chip weight is perceived by the consumer as superior.

Because of the metallic composition of the typical disk inserts, however, unequal expansion and contraction of the disk, relative to the surrounding plastic material, may occur during heating and cooling of the chip. Unequal expansion and contraction of chip components may cause slippage and gapping or other forms of separation between adjoining separately molded, plastic areas and, depending on the chip design, breakage and detachment of sections of the chip body.

Designs may be printed upon the plastic surfaces of a chip using a variety of processes including dye sublimation printing. Dye sublimation printing causes dye to penetrate the surface of a substrate so that the printed images are tightly bound within the substrate, present a minimal profile above the substrate surface, and are highly resistant to wear. When dye is heated during a sublimation transfer process, it vaporizes, and the vapors penetrate the adjacent substrate by approximately 0.002 in. to 0.25 in. If a chip is to be subjected to dye sublimation printing, it should be constructed of material that is capable of withstanding temperatures of approximately 280° F. to 420° F. necessary to vaporize the dye.

In the prior art, chips printed using dye sublimation have been molded from a single slug of polyester with no metal insert. The sublimation printing process has been used to print edge colors and face designs onto the single-part chips.

What is needed, therefore, is a means for providing an insert for stabilizing the chip elements relative to one another, and in particular a method of providing a metallic insert for a gaming chip or token that provides the required weight enhancement without inducing substantial stress within, and among, molded plastic token components during heating and cooling of the token.

SUMMARY OF THE INVENTION

The purpose of this invention is to provide an improved dimensionally stable gaming chip or token formed by molding one or more portions or coatings of plastic material around a stabilizing core or web. Further improvements include enhancement of token weight and utilization of a plastic that withstands elevated temperatures and permits printing of graphics thereon by dye sublimation. The core or web may be formed from metal and the plastic portions may be formed from polyester which accepts printing by dye sublimation particularly well.

Peripheral portions of the web, as well as peripheral portions of a plastic coating, may extend outward to provide engagement and support structures for a second coating, typically disposed in proximity to the periphery of the chip. The web includes means for engaging the coatings, such as apertures, so that portions of a coating above and below the web may join to one another through the apertures during molding. Embodiments of the invention include tokens in which notches in the perimeter of the web create spaces for projections integral to the main body. Interlocking features on the projections as well as ridges or shoulders projecting from the central portion of the main body create means for securing separately molded elements.

Decorative designs or indicia may be imprinted on the top and/or bottom faces of the token using dye sublimation printing, which uses heat to deposit ink on the surface of the token, penetrating the surface and bonding closely with the plastic substrate to yield an inked image that withstands wear. The surface of the token may be textured to yield a matte finish, augmenting the look and feel of the token in use.

The present invention can replace sublimation printing on the edge of the token since contrasting colors may be provided during molding of the token through successive injections of differing colored plastic. The alternating colors of peripheral segments typically present a brighter color contrast than that available with printing. The weight of the token, enhanced by the provision of the web, not only increases customer perceptance of value but also yields acoustic properties similar to those of original clay gaming chips.

It should be appreciated that in referencing tokens such a device may include gaming chips, such as poker chips; game pieces for board games such as checker pieces; drink or coat check tokens; or tokens used as party favors, coupons or business cards.

Other advantages of the invention will become apparent from the following description taken in connection with the accompanying drawings, wherein is set forth by way of illustration and example an embodiment of the present invention.

DETAILED DESCRIPTION

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
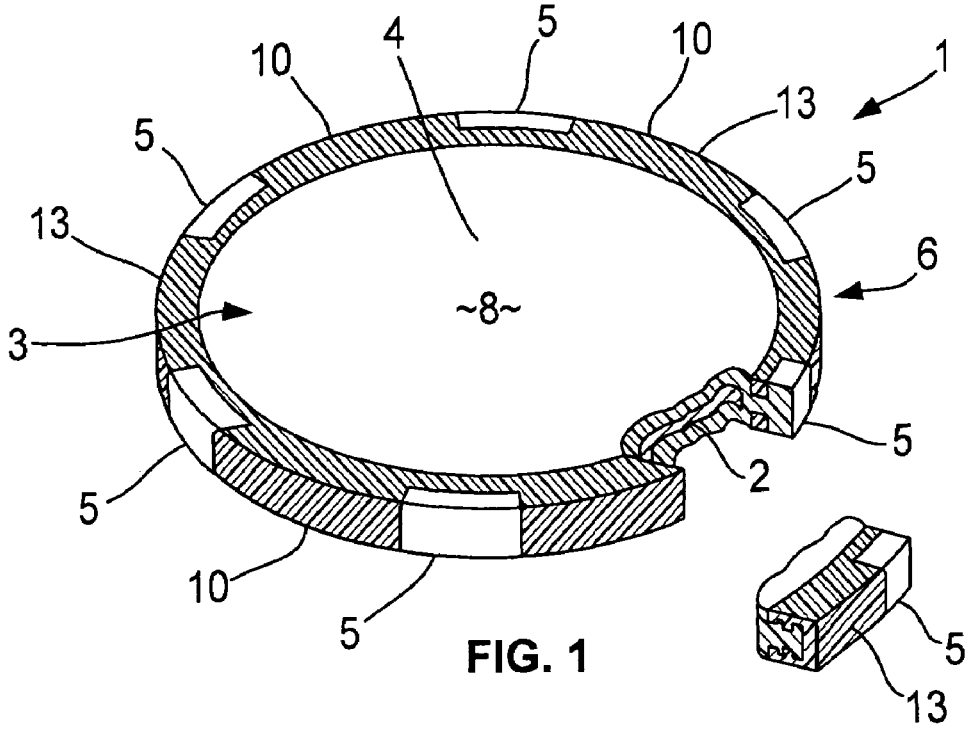
FIG. 1 is a perspective view of a token according to the present invention with a portion of the token broken away to reveal internal details.
Figure 2:
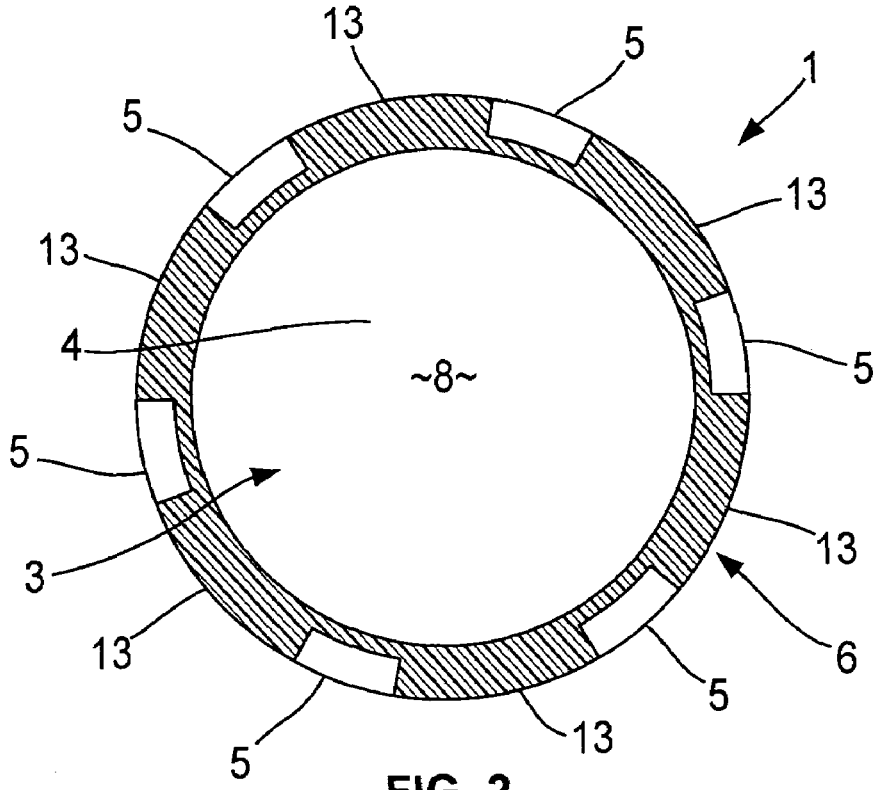
FIG. 2 is a plan view of the token.

Referring now to FIGS. 1 through 9, there is shown in FIG. 1, in perspective view, a gaming chip or token having the general shape of a disk. The token 1 is formed from an internal web 2, a main body 3 including a central portion 4 with edge segments 5 projecting in radially and outwardly spaced relation thereto, and a secondary body portion 6 of a contrasting color and extending around the outer periphery of the main body central portion 4 and between the main body edge segments 5 to create an edge design. The token includes a generally planar, flat, top face 8, a similar opposing bottom face (not shown) and a narrow, peripheral edge 10.

The token 1 may present a design such as areas of contrasting color. In the illustration of FIG. 1, the central portion 4 of the top face of the token 1 is light in coloration as are the edge segments 5 extending along the periphery. The central portion 4 and the edge segments 5 are contiguous, forming the integral main body 3 which is formed from plastic molded as a first layer or coating onto the integral web 2. In the preferred embodiment, the web 2 is metallic. The main body 3 encloses at least a portion of the web 2 and preferably most or all of the web 2. The secondary body portion 6 comprises a ring of darker, contrasting colored plastic formed around the edge segments 5 proximate to the periphery and provides contrasting edge segments 13. The secondary body portion 6 may be referred to as a second coating which is molded around the web and adjacent portions of the main body 3.

Typically, the external portions or outer layers of the token 1, as described above, are formed of colored plastic molded in sequence. In the example provided in FIGS. 1 and 2, the light colored areas correspond to the main body 3 that is formed around the internal web 2 via injection molding or stamping. After formation of the main body 3, the secondary body portion 6 of contrasting coloration is formed by injecting hot, melted plastic into a mold (not shown) that both holds the previously formed main body 3 and provides open spaces for accepting the injected plastic. Although, as shown, the secondary body portion or peripheral ring 6 may be integral so that any one portion of the ring 6 is contiguous with adjoining portions, the ring 6 may be divided into separate segments bonded to adjoining edge segments 5 of the main body 3.

Figure 3:
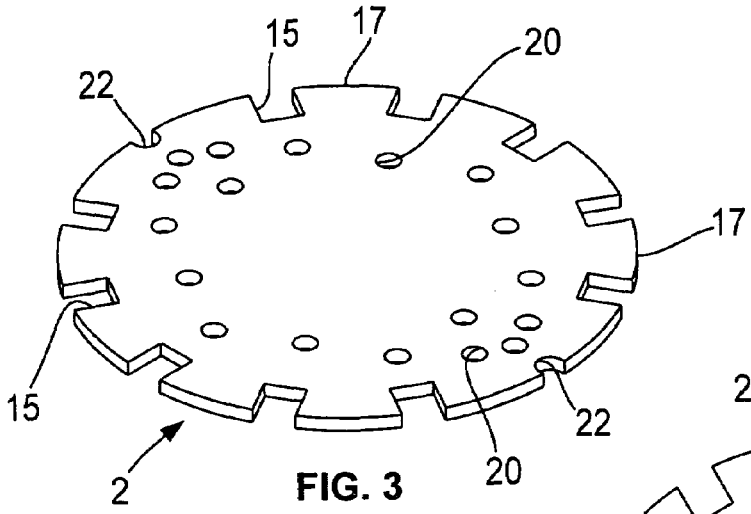
FIG. 3 is a perspective view of an internal web.
Figure 4:
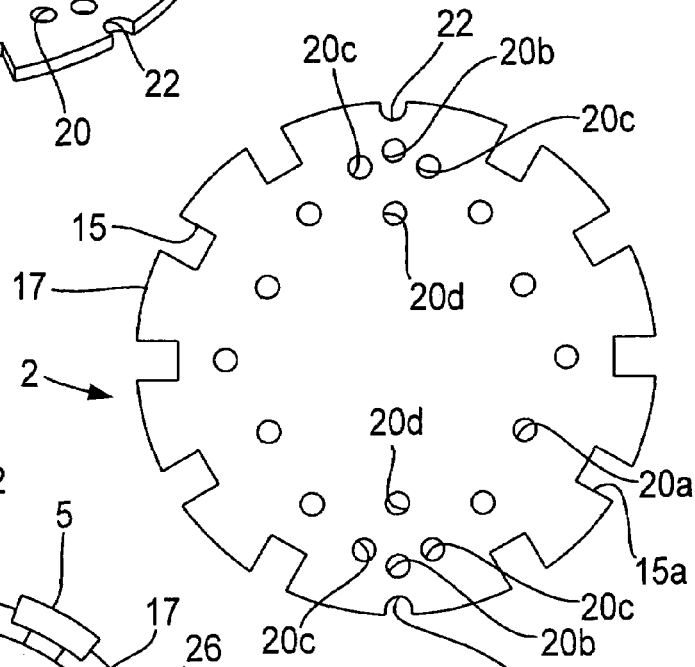
FIG. 4 is a plan view of the web.

The inner web 2 is preferably formed from metal to augment the weight or heft of the token 1 over that which is typically provided by plastic construction alone. A preferred configuration for the metallic web 2 is shown in FIGS. 3 and 4. The web 40 is constructed prior to fabrication of the main body 3 and provides a support structure both to augment the final weight of the token 1 and to secure and stabilize the overall token structure including the main body 3 and peripheral edge segments 5. As shown in the illustrated embodiment, the web 2 has a generally disk-shaped structure, with a diameter somewhat less than that of the final diameter of the token 1 to avoid protrusion of the edge of the web 2 to the peripheral edge 10 of the token 1.

Segmented slots 15 are formed along the periphery of the web 2 and are separated from one another by adjacent outer projections or tabs 17. Holes or apertures 20 project through the web 2, typically inward of the slots 15, to allow melted plastic to flow therethrough during molding of the main body 3 around the web 2. Small, axially opposed registration notches 22 are located near the perimeter of the web 2. These notches 22 are used to position the web 2 within the mold apparatus during injection of material to form the main body 3.

Figure 5:
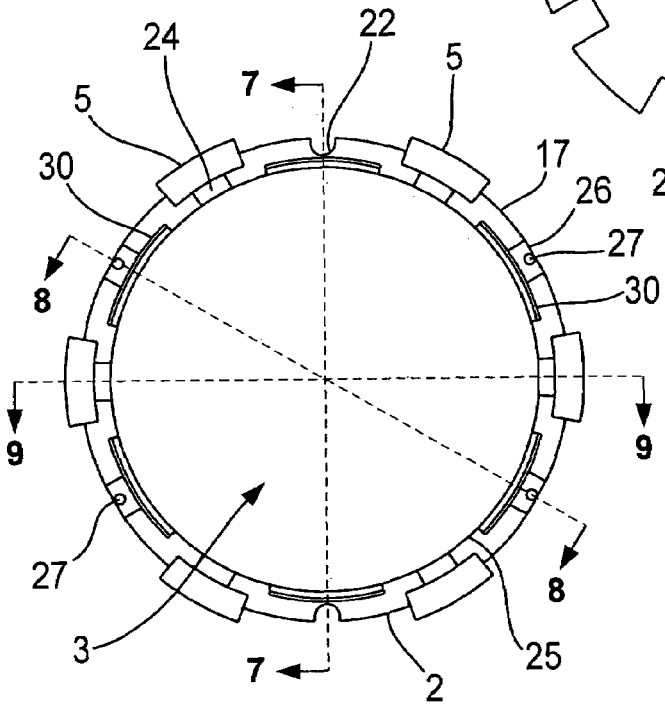
FIG. 5 is a plan view of a partially constructed token including the web and main body.

As shown in FIGS. 4 and 5, the main body 3 is formed to surround and encapsulate a substantial portion of the web 2. During molding of the main body 3, melted plastic flows not only through holes 20 but out of and around the inward edges of the slots 15. The edge segments 5 of the main body 3 are typically positioned to coincide with the slots 15, so that the edge segments 5 are directly contiguous with the plastic material injected to fill the slots 15. After hardening, the first portion of injected material forms a lateral connector or spoke 24 connecting the edge segment 5 to the rest of the main body 3. As illustrated, edge segments 5 correspond to only every other slot 15. The remaining slots 15 create spaces for receiving plastic material that forms alternative support members 26 including upwardly and downwardly projecting posts 27 and upwardly and downwardly projecting flanges or shoulders 30 designed to engage the contrasting colored edge segments 13 of the secondary body portion 6.

The shoulders 30 are spaced outward from the main body 3 by a trough 32. During injection of the material forming the secondary body portion 6, a portion of the material flows into the trough 32 and hardens to lock or hold the contrasting edge segment 13 in position against the central portion 4 of the main body 3 to resist separation upon cooling of the separately formed portions or layers. The posts 27 are surrounded by the material of the edge segments 13 after injection molding is complete and serve to further stabilize and secure the secondary body portion 6 relative to the main body 3. It should be appreciated that other structures than those shown, such as bosses or barbs, could be used to secure the secondary body portion 6 to the main body 3.

In order to enhance the feel of the token 1 in the hands of the user and to avoid a slick or slippery surface, the outer surfaces of the token 1 may be provided with a texture such as a cross-hatched design or matrix of miniscule nubs or ridges. This texture may be cut, pressed, milled or etched into the surface of the token 1 after token production or may be provided by a corresponding pattern on the interior surface of the mold(s) used to form the tokens 1 such as matte textures produced through electrical discharge machining (EDM). The selected depth of texture should be optimized to accept printing without causing excessive diffusion of the printed image.

In addition to making the token 1 easier to grip, a textured surface affects the acoustic characteristics of the token 1 making it less likely to emit a high-pitched rattle or clink when dropped on a hard surface. These acoustic characteristics and general feel of the token 1 are further augmented by producing the token 1 from polyester-based plastic which is somewhat softer than the commonly used ABS plastics.

Graphics or designs, including text and images, may be printed on surfaces of the token 1. In particular, the central portion 4 of the main body 3 is preferably formed from a light colored plastic and sized relatively large to the size of the token 1 as a whole to provide an appropriately sized area for accepting a printed design or indicia. The preferred printing process utilized to print designs on the tokens 1 is the dye sublimation process referenced previously.

During sublimation printing, the temperature of the token 1 may increase considerably and rapidly from ambient temperature. This rise in temperature is followed by a subsequent fall in temperature after the sublimation process is complete. As the temperature of the token 1 increases, and then decreases, the plastic material of the main body 3 and secondary body portion 6, and the metal of the web 2, all tend to expand and contract. Materials of differing compositions typically expand and contract at different rates, and to different extents, which is typically the case for the otherwise advantageous plastic and metal materials selected for token 1 construction. Because of the novel construction of the present invention, however, deleterious effects resulting from disparate expansion and contraction of token materials are considerably mitigated.

The apertures 20 located in the web 2 are positioned generally near the periphery of the web 2 to prevent shrinkage of the main body 3 during cooling. While the interlocking features of the posts 27 and shoulders 30 help hold the secondary body portion 6 to the main body 3, the main body 3 itself is stabilized by appropriate placement of the apertures 20. For example, as shown in FIG. 4, apertures 20 are typically placed in alignment with slots 15. The apertures 20 in the web 2 allow plastic material of the main body 3 to flow therethrough, connecting the upper central portion 4*a* of the main body 3 to the lower central portion 4*b* (see FIGS. 7-9).

Material passing through an aperture 20*a*, and an adjoining slot 15*a*, acts to lock or stabilize the main body 3 around the web 2 and prevent shrinkage of the material of the main body 3 toward the center of the token 1. Portions of the main body 3 in proximity to the registration notches 22, however, are not stabilized by material passing through a slot 15 since the notch 22 replaces a slot 15 and does not receive material contiguous with the main body 3. Therefore, an increased number of apertures 20 are disposed in proximity to the registration notches 22 to stabilize proximate areas of the main body 3 (see FIGS. 3 and 4). As shown, apertures 20*b* are disposed radially outward from the other apertures 20 and are augmented by apertures 20*c*, on either side of 20*b*, and 20*d*, inward of 20*b*. The web 2 therefore provides an advantageous clustering of apertures 20*b*, 20*c* and 20*d* as means of stabilizing the main body 3 and preventing shrinkage near the notches 22.

As the web 2 itself expands and contracts during heating and cooling, pressure exerted by the peripheral edges of the web tabs 17 against the edge segments 13 is counteracted by the overlapping engagement of material forming the secondary body portion 6 with the shoulders 30 formed peripherally around the main body 3. The overlapping engagement of portions of the main body 3 with the secondary body portion 6 resists sliding or gapping between the secondary body portion 6 and the main body 3, or in other words prevents separation of the adjoining sections of molded plastic. Projection of posts 27 from the main body 3 into the secondary body portion 6 further functions to prevent slipping or gapping between the main body 3 and secondary body portion 6.

As the plastic is locked into position via stabilization means such as the aforementioned apertures 20, discrete zones of stabilization are created proximate to each aperture 20. Plastic material proximate to an aperture 20 is relatively stable and free of shrinkage, with shrinkage increasing with further distance form the aperture 20. If apertures 20 are disposed radially around a web 2, therefore, there are zones or arcs between adjoining apertures 20 in which shrinkage tends to increase toward the center of the arc. Therefore, apertures 20 are preferably spaced one from another so that the arc length is reduced to a distance in which any shrinkage occurring within the bounds of the arc is substantially imperceptible. The radial spacing of the apertures 20 need not be uniform but may be varied, as may the distance between the apertures 20 and the center of the web 2, to account for predicted or observed variations in shrinkage—particularly variations in shrinkage due to asymmetrical elements of the web 2 or main body 3.

Figure 6:
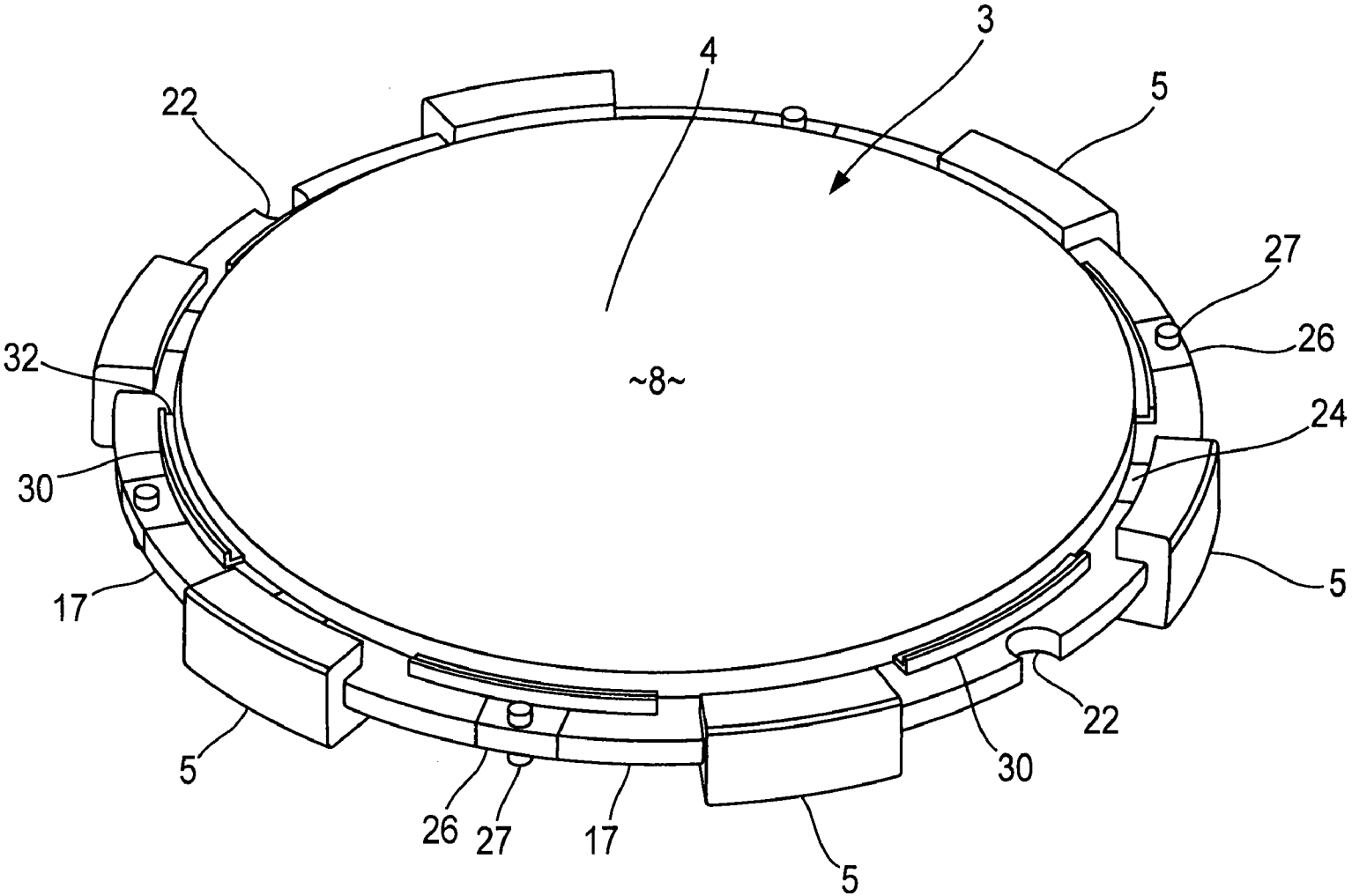
FIG. 6 is a perspective view of a partially constructed token including the web and main body.
Figure 7:
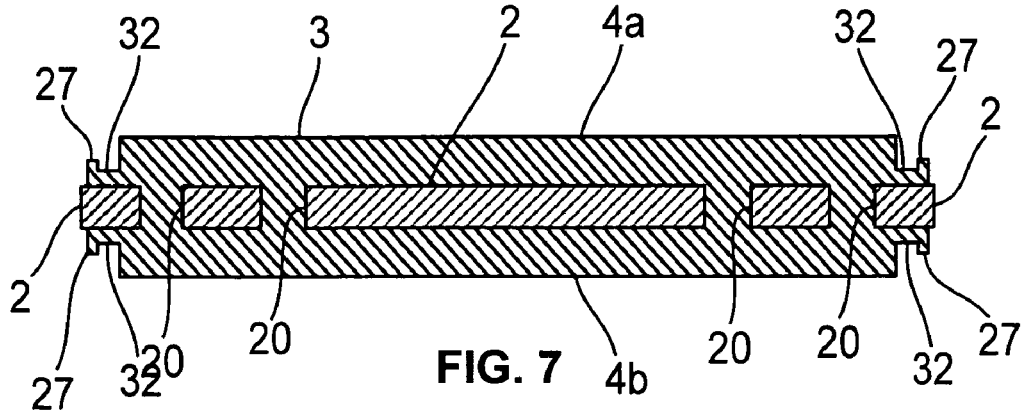
FIG. 7 is cross section taken along line 7-7 in FIG. 5.
Figure 8:
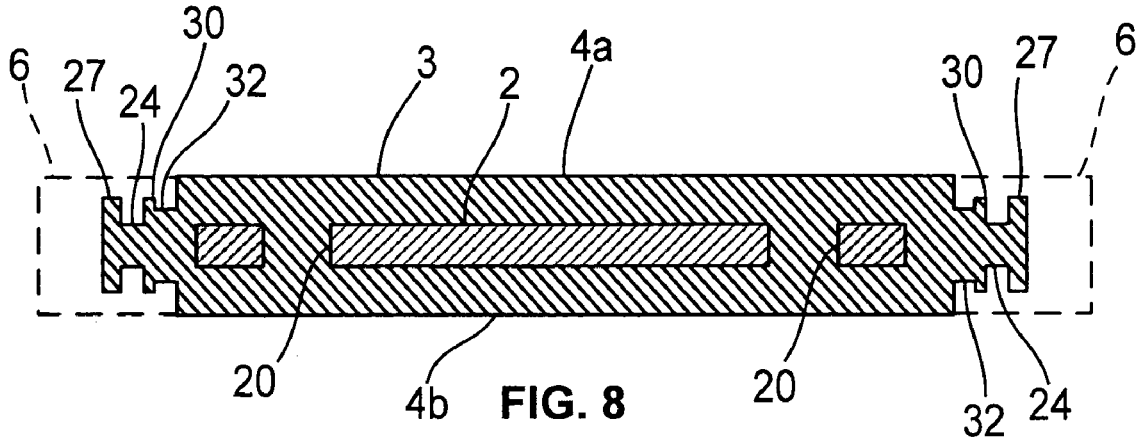
FIG. 8 is cross section taken along line 8-8 in FIG. 5.
Figure 9:
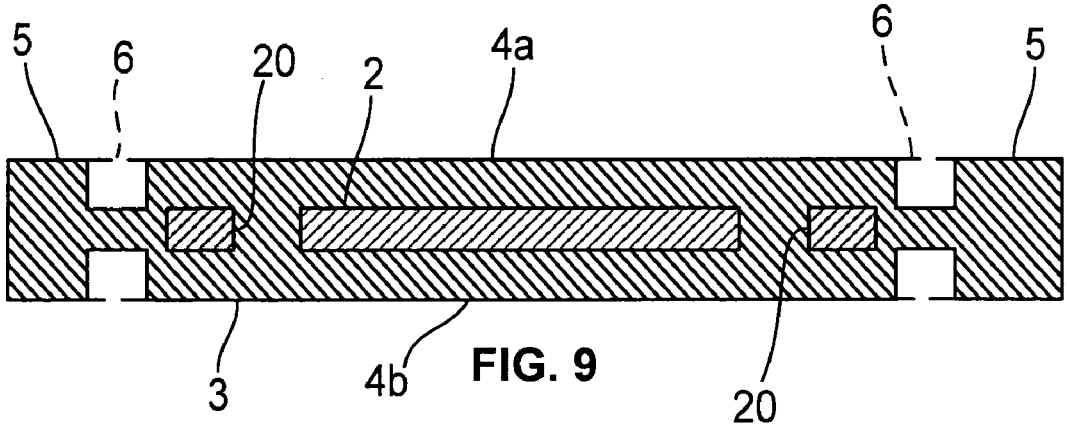
FIG. 9 is cross section taken along line 9-9 in FIG. 5.

To construct a token 1 as described in the above embodiment, the metallic web 2 is cut from stock material using a die. The web 2 is inserted into a first plastic injection mold in registration with the registration notches 22. Molten plastic, such as a polyester based polymer or copolymer, is injected to fill the voids in the first mold and form the main body 3 as shown in FIGS. 5 and 6. The first assembly, comprising the web 2 and main body 3 is removed from the first mold and inserted into a second mold. Molten plastic, typically of a contrasting color to that of the main body 3, is injected to fill the voids in the second mold and form the secondary body portion or peripheral ring 6.

After construction of the token 1, it may be printed with selected designs or indicia. The stabilizing interlock and web aperture structures associated with the token 1 allow it to withstand subjection to heat during dye sublimation printing. The token 1 may be printed by first placing it into a print registration device (not shown). A dye transfer sheet (not shown) is placed into the print registration device so that the image or images on the sheet align with token 1. The print registration device is inserted into a dye sublimation printing press (not shown). A printing surface in the press aligned with the token, and in contact with the dye transfer sheet, is heated. Heat transferred from the printing surface to the dye transfer sheet causes the dye on the sheet to sublimate and deposit onto, and partially within, the proximate surface of the token 1.

It is to be understood that while certain forms of this invention have been illustrated and described, it is not limited thereto except insofar as such limitations are included in the following claims and allowable equivalents thereof. For example, it is foreseen that the secondary body portion 6 could extend axially inward and substantially incorporate and replace the structure of the web 2 described in the above embodiment. In this alternative embodiment, the secondary body portion 6 and integral web would be molded first to provide an attachment structure for subsequent molded sections of the token 1 such as a main body and/or further contrasting colored edge segments 13. As a further alternative, the web 2 could be molded contiguous with the main body 3 such that interlock features and/or apertures on the unitary web/main body secure the secondary body portion 6.

It should be appreciated that the shoulders 30, posts 27 and apertures 20 may take forms other than those illustrated in the examples herein. For example, the apertures 20 need not be circular but may be oblong or formed as slots, rectangles, or triangles. The shoulders 30 may be segmented or comprised of multiple protrusions and the posts 27 may take forms other than the generally cylindrical shape shown in the drawings.

It should also be appreciated that a token may be constructed according to the methods disclosed herein without separate edge segments (i.e. with a unitary edge or periphery of one color plastic and/or supplied by one injection cycle) or with all molded plastic comprising the token having a single color, and that the web may be constructed of material other than metal or plastic. It is also foreseen that a token may be constructed according to the methods and structures disclosed herein wherein the token presents a shape other than circular, such as oval, irregular, or polygonal such as triangular, quadrilateral, pentagonal or hexagonal.

Having thus described the invention, what is claimed as new and desired to be secured by Letters Patent is as follows:

1. A token comprising:

a web of rigid material;

a main body formed from plastic material and molded onto and enclosing at least a central portion of both sides of said web; wherein a plurality of apertures are formed in said web, said plastic material forming said main body extending through said apertures to connect a first portion of said main body on a first side of said web to a second portion of said main body on a second side of said web; wherein arc lengths between adjoining apertures disposed generally, radially around said web are sized to avoid visually perceptible shrinkage of the main body after heating; said main body having an interlock structure projecting radially outward from a central portion thereof:

a secondary body molded radially adjacent to said main body and to engage said interlock structure of said main body to resist radial separation of said secondary body from said main body upon expansion and contraction due to heating and cooling of said web, said main body and said secondary body.

2. A token comprising:

a web of rigid material, said web including a central portion, a periphery, and opposing, relatively planar top and bottom surfaces parallel to a major plane of said web, a plurality of apertures formed in and projecting through said top and bottom surfaces of said web in radially spaced relationship proximate said periphery thereof a central body molded onto and enclosing a central portion of said web with material forming said central body extending through said apertures formed in said web; said central body including at least one radially outward projecting interlock member comprising an axial primary projection generally coplanar with said major plane, said primary projection bearing a secondary projection generally perpendicular to said major plane;

a peripheral body molded radially adjacent said central body and in overlapping relationship with said interlock member to resist radial separation of said peripheral body from said central body.

3. The token as in claim 2, further comprising a plurality of slots disposed around said periphery of said web.

4. The token as in claim 3 wherein at least one of said apertures is formed in said web in inwardly spaced relationship with each of said slots.

5. The token as in claim 3 wherein at least one of said apertures is formed in said web in inwardly spaced relationship with each of said interlock members.

6. The token as in claim 2, wherein said web comprises metal.

7. The token as in claim 2, wherein said central body is formed from polyester.

8. The token as in claim 7, wherein portions of an outer surface of said central body bear indicia printed via dye sublimation.

9. A token comprising:

a web of rigid material, said web including a periphery and opposing, relatively planar top and bottom surfaces extending generally parallel to a primary plane thereof, a plurality of apertures formed in and projecting through said web from said top to said bottom surfaces of said web and spaced radially outward from a center of said web;

a main body molded onto and enclosing at least a central portion of said web with material forming said main body extending through said apertures formed in said web; said main body forming a circular central body portion on each side of said web with at least one arcuate interlock member projecting radially outward from each said circular body portion; each said interlock member comprising a primary projection extending radially outward from said circular central body portion and a secondary projection projecting generally perpendicular to said primary plane of said web and outward from said primary projection in spaced relation to said circular central body portion;

a peripheral body molded radially adjacent said circular central body portions of said main body and in overlapping relationship with each said interlock member to resist radial separation of said peripheral body from said circular central body portions.

10. A token comprising:

a web of rigid material, said web including a periphery and opposing, relatively planar top and bottom surfaces extending generally parallel to a primary plane thereof, a plurality of apertures formed in and projecting through said web from said top to said bottom surfaces of said web and spaced radially outward from a center of said web;

a main body molded onto and enclosing at least a central portion of said web with material forming said main body extending through said apertures formed in said web; said main body forming a circular central body portion on each side of said web, a plurality of edge segments spaced radially outward from said circular central body portions and a plurality of arcuate interlock members projecting radially outward and in closely spaced relation from said circular body portions on each side of said web; each said arcuate interlock member comprising a primary projection extending radially outward from said circular central body portion and a secondary projection projecting generally perpendicular to said primary plane of said web and outward from said primary projection; each said arcuate interlock member extending between adjacent edge segments and not extending between said edge segments and said circular central body;

a peripheral body molded radially adjacent said circular central body portions and said edge segments of said main body and in overlapping relationship with said arcuate interlock members to resist radial separation of said peripheral body from said circular central body portions.

* * * * *